United States Patent [19]

Lu

[11] 4,221,856

[45] Sep. 9, 1980

[54] ELECTROGRAPHIC TONER CONTAINING RESIN-COMPATIBLE QUATERNARY AMMONIUM COMPOUND

[75] Inventor: Chin H. Lu, Webster, N.Y.

[73] Assignee: Xerox Corporation, Stamford, Conn.

[21] Appl. No.: 892,635

[22] Filed: Apr. 3, 1978

[51] Int. Cl.[3] ..... G03G 9/10

[52] U.S. Cl. ..... 430/110; 430/108; 430/115; 430/904; 260/DIG. 20; 430/528

[58] Field of Search ..... 282/62.1; 96/1 SD; 427/16; 430/110, 904, 108, 115, 528; 260/DIG. 20

[56] References Cited

U.S. PATENT DOCUMENTS

| | | | |
|---|---|---|---|
| 3,729,418 | 4/1973 | Machida et al. | 252/62.1 |
| 3,960,738 | 6/1976 | O'Brien et al. | 252/62.1 |
| 3,977,983 | 8/1976 | Tsuneda | 252/62.1 |

FOREIGN PATENT DOCUMENTS

| | | | |
|---|---|---|---|
| 2702526 | 7/1977 | Fed. Rep. of Germany | 252/62.1 |

*Primary Examiner*—John D. Welsh
*Attorney, Agent, or Firm*—E. O. Palazzo

[57] ABSTRACT

Toners comprised of a resin and a quaternary ammonium compound of the formula

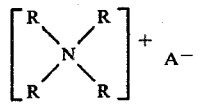

in which at least two R radicals are hydrocarbon radicals having from about 8 to about 22 carbon atoms and each other R is a hydrogen or hydrocarbon radical having from 1 to about 8 carbon atoms, and A is an anion for example, sulfate, sulfonate, nitrate, borate, chlorate, and the halogens such as iodide, chloride, and bromide. Methods of their formation and use in various electrophotographic imaging systems is disclosed. The quaternary ammonium compound is generally present as a coating on a pigment that is used in the toner, such pigment being for example carbon black. Toners containing the above described quaternary ammonium compounds generally result in a toner containing a positive charge thus allowing development of negative images that may be formed on photoreceptors, especially organic photoreceptors. A developer composition comprising the above ingredients together with a carrier such as steel were found suitable for use in developing electrostatic latent images.

17 Claims, No Drawings

ELECTROGRAPHIC TONER CONTAINING RESIN-COMPATIBLE QUATERNARY AMMONIUM COMPOUND

BACKGROUND OF THE INVENTION

This invention generally relates to new developers and the use of such developers for developing images in an electrophotographic system. More specifically, the present invention is concerned with new developers containing compatible quaternary ammonium compounds and the use of such developers for developing electrostatic latent images.

In the electrophotographic process and more specifically the xerographic process, a plate generally comprising a conductive backing upon which is placed a photoconductive insulating surface is uniformly charged, and subsequently the photoconductive surface is exposed to a light image of the original to be reproduced. The photoconductive surface is made in such a manner so as to cause it to become conductive under the influence of the light image in order that the electrostatic charge found thereon can be selectively dissipated to produce what is developed by means of a variety of pigmented resin materials specifically made for this purpose, such as toners. The toner material used is electrostatically attracted to the latent image areas on the plate in proportion to the charge concentration contained thereon. For example, areas of high charge of concentration become areas of high toner density and correspondingly low charge images become proportionately less dense. Subsequently, the developed image is transferred to a final support material such as paper and fixed thereto for a permanent record or copy of the original.

Many methods are known for applying the electroscopic particles to the electrostatic latent image to be developed such as, for example, the development method described in E. N. Wise, U.S. Pat. No. 3,618,552, "Cascade Development". Another method of developing electrostatic latent images is in the magnetic brush process as disclosed for example in U.S. Pat. Nos. 2,874,063; 3,251,706 and 3,357,402. In this method a developer material containing toner and magnetic carrier particles is carried by a magnet with the magnetic field of the magnet causing alignment of the magnetic carrier into a brush like configuration. The magnetic brush is brought in close proximity of the electrostatic latent image bearing surface and the toner particles are drawn from the brush to the electrostatic latent image by electrostatic attraction. Other methods of development include for example powder cloud development as described in C. F. Carlson U.S. Pat. No. 2,221,776, touchdown development as described in R. W. Gundlach U.S. Pat. No. 3,166,432 and cascade development as described in U.S. Pat. No. 3,099,943.

The image itself can be fixed by using a number of different techniques including for example vapor fixing, heat fixing, pressure fixing or combinations thereof as described for example in U.S. Pat. No. 3,539,161.

Many times it is desirable in electrophotographic systems to produce a reverse copy of the original. Thus, for example, it may be desired to produce a negative copy from a positive original or a positive copy from a negative original. Normally this is referred to as image reversal and in electrostatic printing image reversal can be accomplished by applying to the image a developer powder which is repelled by the charged areas of the image and adheres to the discharged areas. Also such reversal developers or more specifically toners containing positive charges are found to be very useful and effective in electrophotographic systems using organic photoreceptors which in many instances are initially charged negatively rather than positively thereby necessitating the need for a positively charged toner. Reversal developers are described in U.S. Pat. No. 2,986,521, such developers being comprised of electroscopic material coated with finely divided colloidal silica. When used in an electrostatic development system, development of electrostatic images on negatively charged surfaces is accomplished by applying the electroscopic material having a positive triboelectric relationship with respect to the colloidal silica.

These developers have a tendency to lose their positive charge over a period of time, are difficult to prepare and as a result the quality of the image can be adversely affected over a period of time. The use of charge control agents in developers is known, for example as described in U.S. Pat. No. 3,893,935, but such materials are soluble in water, causing them to be leached to the toner surface and also toners containing these materials are humidity sensitive. Also, these materials are incompatible with thermoplastic resins and it is very difficult to uniformly disperse or dissolve such materials in the toner. This causes particle-to-particle non-uniformity and wide distribution of electrical charge which reduces the quality of the image developed.

Accordingly, there is a need for a developer which can be used in a reversal system, and more specifically there is a need for a positively charged toner that has improved resistance to moisture leaching, is of improved pigment dispersion and of improved toner particle-to-particle uniformity.

SUMMARY OF THE INVENTION

It is an object of the invention to provide a toner which overcomes the above-noted disadvantages.

It is a further object of this invention to provide a developer which contains toner and carrier with the toner being charged positively.

Another object of this invention is to provide developers that have improved pigment dispersion and improved toner particle-to-particle uniformity.

Yet another object of this invention is to provide developers containing toners and carriers of improved triboelectric charge and which are resistive to moisture leaching.

It is yet another object of this invention to provide toners which will develop electrostatic images containing negative charges on the photoreceptor surface and which will transfer effectively electrostatically from such a photoreceptor to plain bond paper without causing blurring.

These and other objects of the instant invention are accomplished by preparing developers comprised of toner resin, carrier material, and a quaternary ammonium compound. The resulting toner due to the presence of the quaternary ammonium compound can contain a positive charge on its surface thus allowing in a preferred embodiment such a toner to be used for the development of electrostatic images wherein a photoreceptor is used containing a negative charge.

The quaternary ammonium compounds that are useful in the present invention are of the general formula:

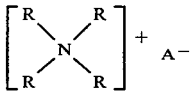

in which at least two R radicals are hydrocarbon radicals having from about 8 to about 22 carbon atoms and each other R is a hydrogen or hydrocarbon radicals having from 1 to about 8 carbon atoms, and A is an anion for example, sulfate, sulfonate, nitrate, borate, chlorate, and the halogens such as iodide, chloride, and bromide.

Examples of hydrocarbon radicals include methyl, ethyl, propyl, butyl, isobutyl, tertiary butyl, pentyl, octyl, nonyl, pentadecamyl, eicosene.

Illustrative examples of preferred quaternary ammonium compounds utilized in the practice of the present invention include distearyl dimethyl ammonium chloride, dicetyl dimethyl ammonium chloride, dicetyl methyl benzyl ammonium bromide, stearyl cetyl dimethyl ammonium chloride, dicetyl dimethyl ammonium bromide, dimyristyl dimethyl ammonium iodide, dimyristyl methyl benzyl ammonium chloride, and the like.

The quaternary ammonium compound can be used in any amount that results in a toner that is charged positively in comparison to the carrier and that develops and electrostatically transfers well. For example, the amount of quaternary ammonium compounds being present ranges from between about 0.1 and about 10 weight percent of the total toner weight and preferably from about 0.5 to 5 percent of the toner. Generally the quaternary ammonium compound is coated on a pigment such as carbon black which is used in the developing compositions.

Several methods may be employed to produce the toner of the present invention, one typical method involving melt-blending the resin and the pigment coated with a quaternary ammonium compound, followed by mechanical attrition. Other methods include those known in the art such as spray-drying, melt dispersion and dispersion polymerization. For example a solvent dispersion of resin, pigment, and quaternary ammonium compound are spray dryed under controlled conditions thereby resulting in the desired product.

While any suitable resin may be employed in the system of the present invention, typical of such resins are polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorostyrene, vinyl napthalene; ethylenecally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred since greater image definition and density is obtained with their use. The styrene resin employed may be a homopolymer of styrene or styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more resins if desired, preferably other vinyl resins which insure good triboelectric properties and uniform resistance against physical degradation. However, non-vinyl type thermoplastic resins may also be employed including resin modified phenol-formaldehyde resins, oil modified epoxy resins, polyurethane resins, cellulosic resins, polyether resins and mixtures thereof.

Also esterification products of a dicarboxylic acid and a diol comprising a diphenol may be used as a preferred resin material for the toner composition of the present invention. These materials are illustrated in U.S. Pat. No. 3,655,374 totally incorporated herein by reference, the diphenol reactant being of the formula as shown in Column 4, beginning at line 5 of this patent and the dicarboxylic acid being of the formula as shown in Column 6 of the above patent. The resin is present in an amount so that the total of all ingredients used in the toner total about 100%, thus when 5 percent by weight of quaternary ammonium compound is used and 10 percent by weight of pigment such as carbon black, about 85 percent by weight of resin material is used.

Optimum electrophotographic results are achieved with styrene butylmethacrylate copolymers, styrene vinyl toluene copolymers, styrene acrylate copolymers, polyester resins, predominantly styrene or polystyrene base resins as generally described in U.S. Reissue 25,136 to Carlson and polystyrene blends as described in U.S. Pat. No. 2,788,288 to Rheinfrank and Jones.

Any suitable pigment or dye may be employed as the colorant for the toner particles, such materials being well known and including for example, carbon black, nigrosine dye, aniline blue, calco oil blue, chrome yellow, ultramarine blue, DuPont oil red, methylene blue chloride, phthalocyanine blue and mixtures thereof. The pigment or dye should be present in the toner and in sufficient quantity to render it highly colored so that it will form a clearly visible image on the recording member. For example, where conventional xerographic copies of documents are desired, the toner may comprise a black pigment such as carbon black or a black dye such as Amaplast black dye available from the National Aniline Products Inc. Preferably the pigment is employed in amounts from about 3% to about 20% by weight based on the total weight of toner, however, if the toner color employed is a dye, substantially smaller quantities of the color may be used. It is this pigment that is coated with a quaternary ammonium compound of the present invention.

Any suitable carrier material can be employed as long as such particles are capable of triboelectrically obtaining a charge of opposite polarity to that of the toner particles, in the present invention in one embodiment that would be a negative polarity, to that of the toner particles which are positively charged so that the toner particles will adhere to and surround the carrier particles. Thus the carriers can be selected so that the toner particles acquire a charge of a positive polarity and include materials such as sodium chloride, ammonium chloride, ammonium potassium chloride, Rochelle salt, sodium nitrate, aluminum nitrate, potassium chlorate, granular zircon, granular silicon, methylmethacrylate, glass, steel, nickel, iron ferrites, silicon dioxide and the like. The carriers can be used with or without the coating. Many of the typical carriers that can be used are described in U.S. Pat. Nos. 2,618,441; 2,638,416; 2,618,522; 3,591,503; 3,533,835; and 3,526,533. Also nickel berry carriers as described in U.S. Pat. Nos. 3,847,604 and 3,767,598 can be employed, these carriers being modular carrier beads of nickel characterized by surface of reoccurring recesses and protrusions providing particles with a relatively large external area. The diameter of the coated carrier particle is from about 50 to about 1000 microns, thus allowing the carrier to possess sufficient density and inertia to avoid adherence to the electrostatic images during the development process.

The carrier may be employed with the toner composition in any suitable combination, however best results are obtained when about 1 part per toner is used and about 10 to about 200 parts by weight of carrier.

Toner compositions of the present invention may be used to develop electrostatic latent images on any suitable electrostatic surface capable of retaining charge including conventional photoconductors, however the toners of the present invention are best utilized in systems wherein a negative charge resides on the photoreceptor and this usually occurs with organic photoreceptors, illustrative examples of such photoreceptors being polyvinyl carbazole, 4-dimethylaminobenzylidene, benzhydrazide; 2-benzylidene-amino-carbazole, polyvinyl carbazole; (2-nitro-benzylidene)-p-bromo-aniline; 2,4-diphenyl-quinazoline; 1,2,4-triazine; 1,5-diphenyl-3-methyl pyrazoline 2-(4'-dimethyl-amino phenyl)-benzoxazole; 3-amino-carbazole; polyvinylcarbazole-tritrofluorenone charge transfer comples; phthalocyanines and mixtures thereof.

The following examples are being supplied to further define the species of the present invention, it being noted that these examples are intended to illustrate and not limit the scope of the present invention. Parts and percentages are by weight unless otherwise indicated.

EXAMPLE I

Five (5) parts of Arosurf TA-100, dimethyl distearyl ammonium chloride available from Ashland Chemical Company, was dissolved in a solvent mixture containing 180 parts of deionized water and 180 parts of isopropyl alcohol. 100 parts of Mogul L, an acidic (pH 3.4) carbon black available from Cabot Corporation was added to the solution and was vigorously stirred for 30 minutes. A dilute hydrochloric acid solution comprising 3 parts of concentrated (37%) hydrochloric acid and 250 parts of deionized water was slowly added to the mixture with stirring. The stirring continued for 14 minutes after which the slurry was filtered, washed and dried at about 210° F. overnight. Lumps eventually obtained were broken up with a spatula and the resulting material was tested for hydrophobicity by placing the powder in water. The carbon black coated with this material floated on water which indicated it was hydrophobic.

Three toners as specified below were prepared by melt blending, followed by mechanical attrition.

Toner A (control)—10% Mogul L and 90% styrene/n-butyl methacrylate (65/35) copolymer resin.

Toner B—10% Mogul L, 0.5% distearyl dimethyl ammonium chloride Arosurf TA-100 (coated on carbon black), and 89.5% styrene/n-butyl methacrylate (65/35) copolymer resin.

Toner C—10% Mogul L, 0.5% distearyl dimethyl ammonium chloride Arosurf TA-100 (blended in the toner), and 89.5% styrene/n-butyl methacrylate (65/36) copolymer resin.

The triboelectric charge (tribos) of these toners were compared with the tribos of a 0.2% Kynar 201 (vinylidene fluoride resin available from Pennwalt Company) coated Hoeganaes steel carrier (about 150 microns in average diameter) were measured by the procedure described below. 100 parts of the coated carrier and 3 parts of the toner were placed in an 8 ounce glass jar. The jar containing the developer was roll mixed at a linear speed of 90 feet per minute for a specific time. The developer was placed in a stainless steel Faraday cage with 35 micron screen. The triboelectric charge was measured by blowing off the toner from the developer. After 60 minutes of roll mixing, the tribos of these toners are as follows:

| Toner | Additive | Toner Tribo, μc/g (Unit Charge per Gram) |
|---|---|---|
| A (control) | None | −1 |
| B | 0.5% distearyl dimethyl ammonium chloride Arosurf TA-100 coated on carbon black | +26 |
| C | 0.5% distearyl dimethyl ammonium chloride Arosurf TA-100 blended in toner | +18 |

The tribo of Toner B which contained 0.5% Arosurf TA-100 coated on carbon black was significantly higher than the control Toner A which contained no additive, and higher than Toner C which contained 0.5% Arosurf TA-100 blended in the toner. The pigment dispersion and particle-to-particle uniformity of these toners were examined by transmission electron microscopy. Toner B which contained coated carbon black showed excellent pigment dispersion and particle-to-particle uniformity, compared with Toner A and Toner C which showed fair to good pigment dispersion and particle-to-particle uniformity.

EXAMPLE II

Arosurf TA-100 distearly dimethyl ammonium chloride was coated on Regal 330, a basic (pH 8.5) carbon black available from Cabot Corporation, in accordance with the procedure as described in Example I. Three toners of the following composition were prepared by melt blending followed by mechanical attrition.

Toner D (control)—10% Regal 330 carbon black and 90% styrene/n-butyl methacrylate (65/35) copolymer resin.

Toner E—10% Regal 330, 0.5% distearyl dimethyl ammonium chloride Arosurf TA-100 (coated on carbon black), and 89.5% styrene/n-butyl methacrylate (65.35) copolymer resin.

Toner F—10% Regal 330, 0.5% distearyl dimethyl ammonium chloride Arosurf TA-100 (blended in toner), and 89.5% styrene/n-butyl methacrylate (65/35) copolymer resin.

The tribos of these toners were compared with the same carrier described in Example I, with the following results:

| Toner | Additive | Toner Tribo, μc/g (Unit Charge per Gram) |
|---|---|---|
| D | None | +9 |
| E | 0.5% distearyl dimethyl ammonium chloride Arosurf TA-100 coated on carbon black | +22 |
| F | 0.5% distearyl dimethyl ammonium chloride Arosurf TA-100 blended in toner | +16 |

The tribo of Toner E which contained 0.5% Arosurf TA-100 coated on carbon black was significantly higher than Toner D which contained no additive, and higher than Toner F which contained 0.5% Arosurf TA-100 blended in the toner.

Transmission electron microscopy work showed Toner E had excellent and better pigment dispersion and particle-to-particle uniformity than Toner D and Toner F.

EXAMPLE III

Ten (10) parts of distearyl dimethyl ammonium chloride Arosurf TA-100 was coated on 100 parts of Regal 330 carbon black using the procedure described in Example I. Toner G comprising 10% Regal 330, 1% Arosurf TA-100 (coated on carbon black), and 89% styrene/n-butyl methacrylate (65/35) copolymer resin, was prepared by melt blending followed by mechanical attrition. A developer comprising 100 parts of 0.35% PFA (perfluoroalkoxy fluoro resin available from du-Pont Co.) coated on Hoeganaes steel carrier was blended. The toner tribo after 60 minutes of roll mixing was +21 μc/g (unit charge per gram). The developer was print tested in a fixture using a photoreceptor charged negatively in the image area. Prints of good quality with high optical density and low background were obtained.

EXAMPLE IV

Fourteen (14) parts of Arquad 2HT-75, dimethyl di(hydrogenated-tallow) ammonium chloride, 75% active, available from Armak Co. was coated on 100 parts Regal 330 carbon black using the procedure described in Example I. The typical acid composition of tallow is 2.0% myristic, 32.5% polmitic, 14.5% stearic, 48.3% oleic, and 2.7% linoleic. Toner H containing 10% Regal 330, 1.5% Arquad 2HT-75 coated on carbon black, and 88.5% styrene/isobutyl methacrylate (80/20) copolymer resin was prepared by melt blending followed by mechanical attrition. A developer comprising 100 parts of coated carrier described in Example III and 3 parts of Toner H was blended. The toner tribo after 60 minutes of roll mixing was +23 μc/g unit charge per gram. The developer was tested in a fixture using a photoreceptor charged negatively in the image area. Prints of excellent quality were obtained.

Other modifications of the present invention will occur to those skilled in the art upon reading the present disclosure. These are intended to be included within the scope of this invention.

What is claimed is:

1. A developer composition comprised of a carrier, toner resin, and a pigment which is coated with from about 0.1 to about 10 percent of a quaternary ammonium compound thereby causing the toner to become positively charged said quaternary ammonium compound being of the formula:

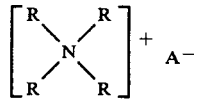

in which at least two R radicals are hydrocarbon radicals having from about 8 to about 22 carbon atoms and each other R is selected from hydrogen and hydrocarbon radicals having from 1 to about 8 carbon atoms, and A is an anion selected from sulphate, sulphonate, nitrate, borate, chlorate, chloride, iodide, and bromide.

2. A developer in accordance with claim 1 wherein the resin used is a styrene copolymer of n-butylmethacrylate, the pigment used is carbon black and the quaternary ammonium compound is dimethyl distearyl ammonium chloride.

3. A developer in accordance with claim 1 wherein the resin is a copolymer of styrene/isobutyl methacrylate and the quaternary ammonium compound is dimethyl di(hydrogenated-tallow) ammonium chloride.

4. A developer in accordance with claim 1 wherein the carrier is steel.

5. A method of imaging comprising forming an electrostatic latent image, contacting the image with a developer composition comprised of a carrier a toner resin, and a pigment which is coated with from about 0.1 to about 10 percent of a quaternary ammonium compound thereby causing the toner to become positively charged, said quaternary ammonium compound being of the formula:

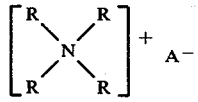

in which at least two R radicals are hydrocarbon radicals having from about 8 to about 22 carbon atoms and each other R is selected from hydrogen and hydrocarbon radicals having from 1 to about 8 carbon atoms, and A is an anion selected from sulphate, sulphonate, nitrate, borate, chlorate, chloride, iodide, and bromide, subsequently transferring the developed image to a paper substrate, and permanently forming the image thereon.

6. A method in accordance with claim 5 wherein the resin is a copolymer of styrene-n-butylmethacrylate, the pigment is carbon black and the quaternary ammonium compound is dimethyl distearyl ammonium chloride.

7. The method in accordance with claim 5 wherein the resin is a copolymer of styrene/isobutyl methacrylate and the quaternary ammonium compound is dimethyl di(hydrogenated-tallow) ammonium chloride.

8. A method in accordance with claim 5 wherein the electrostatic latent image is formed on an organic photoreceptor.

9. A method for imparting a substantially high positive charge to a toner resin which is used in a developer composition comprised of a carrier, a pigment and said toner resin, which comprises adding these materials together with the pigment which is coated with from about 0.1 to about 10 percent of a quaternary ammonium compound of the formula:

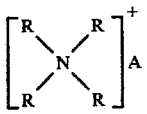

in which at least two R radicals are hydrocarbon radicals having from about 8 to about 22 carbon atoms and each other R is selected from hydrogen and hydrocarbon radicals having from 1 to about 8 carbon atoms, and A is an anion selected from sulphate, sulphonate, nitrate, borate, chlorate, chloride, iodide, and bromide.

10. A method in accordance with claim 9 wherein the resin used is a copolymer of styrene and of n-butyl methacrylate, the pigment is carbon black and the quaternary ammonium compound is dimethyl distearyl ammonium chloride.

11. A method in accordance with claim 9 wherein the resin is a copolymer of styrene/isobutyl methacrylate and the quaternary ammonium compound is dimethyl di(hydrogenated-tallow) ammonium chloride.

12. A method in accordance with claim 9 wherein the positive charge on the toner resin is from about 20 to about 30 microcoulombs per gram, and wherein there results excellent pigment dispersion and particle to particle uniformity.

13. A developer composition comprised of about 3 parts by weight of toner comprising about 10 percent of carbon black containing a coating of distearyl dimethyl ammonium chloride in an amount of from 0.5 percent to 1 percent and a copolymer of styrene/n-butylmethacrylate resin, in an amount of from 85 percent to 90 percent, and 100 parts per weight of a steel carrier coated with vinylidene fluoride.

14. A developer composition in accordance with claim 13 wherein the copolymer of styrene/n-butylmethacrylate resin is present in an amount of from 89 to 90 percent.

15. A developer composition comprised of about 3 parts by weight of toner comprising about 10 percent of carbon black containing a coating of dimethyl di(hydrogenated tallow) ammonium chloride in an amount of from 1 percent to 2 percent, and a copolymer of styrene/isobutylmethacrylate resin, in an amount of from 85 percent to 90 percent, and 100 parts per weight of a steel carrier coated with vinylidene fluoride.

16. A developer composition in accordance with claim 13 where the ratio of styrene to n-butylmethacrylate is 65 to 35.

17. A developer in accordance with claim 15 wherein the ratio of styrene to isobutylmethacrylate is 80 to 20.

* * * * *